US005256066A

United States Patent [19]

LaRussa

[11] Patent Number: 5,256,066

[45] Date of Patent: Oct. 26, 1993

[54] HYBRIDIZED TARGET ACQUISITION TRAINER

[76] Inventor: Joseph LaRussa, 451 Rutledge Dr., Yorktown Hgts., N.Y. 10598

[21] Appl. No.: 669,351

[22] Filed: Mar. 14, 1991

[51] Int. Cl.[5] ..... F41G 3/26

[52] U.S. Cl. ..... 434/21; 434/16

[58] Field of Search ..... 434/20, 26, 11, 16, 434/19, 21, 22, 23, 27; 364/559; 273/433, 434, 437

[56] References Cited

U.S. PATENT DOCUMENTS

| | | | |
|---|---|---|---|
| 3,965,582 | 6/1976 | Bennigsen | 434/20 |
| 4,322,726 | 3/1982 | Collier et al. | 434/20 X |
| 4,333,154 | 6/1982 | Devaud et al. | 364/559 |
| 4,789,339 | 12/1988 | Bagnall-Wild et al. | 434/20 |
| 5,035,622 | 7/1991 | Marshall et al. | 434/16 X |

*Primary Examiner*—Richard J. Apley
*Assistant Examiner*—Glenn Richman
*Attorney, Agent, or Firm*—Handal & Morofsky

[57] ABSTRACT

A weapon simulator for detecting the azimuth and elevation of which the weapon is oriented, comprising a sign mounted onto the weapon into which a playback sequence of a target path, is displayed through.

11 Claims, 4 Drawing Sheets

HYBRIDIZED TARGET ACQUISITION TRAINER

TECHNICAL FIELD

The present invention relates to training devices of the type useful for generating a simulated target, allowing a trainee to acquire the same and neutralize the same as part of a combat training simulation or as a gaming device.

BACKGROUND

Typically, training and gaming simulators involve the use of a cathode-ray tube for the generation of a simulated real world scene, together with targets, threats and, for example, a gun reticle.

In the case of more elaborate simulators, such as tank simulators, the trainee is placed in a compartment modeled after the actual inside cabin of a tank. He is provided with an artificially-generated terrain which is generated from data base information respecting the topographical configuration of a training, together with speed, position and attitude information. The result is the generation of a relatively schematic representation of the real world, together with a time varying representation of targets and threats.

The aiming point of his weaponry is illustrated through the use of a reticle with the object of simulating the appearance of the terrain and target during actual use of a gun on, for example, a real tank. During the use of such a simulator, the operator of the simulator experiences a simulation of the full-range of tank operation and hazards. For example, as the tank moves along the simulated terrain, the view through the simulator changes pointing toward the sky and the terrain and the earth as the tank simulates a path of movement over a hill. Likewise, any threats are presented within the field of view of the trainee and he is given a limited time within which to neutralize such threats or be attacked by them.

A similar approach may be used in aircraft trainers, although, typically, because of the relatively limited range of visual possibilities, the simulation may involve use of models together with an electronically generated reticle.

The success of the above systems is due largely to the fact that successful simulations of in-cabin battle conditions requires only minimal magnitudes of simulation in the azimuth and elevational directions. More particularly, in the case of, for example, a tank mounted gun, the tank operator will see only a few degrees of arc in the horizontal direction (i.e., a few degrees of azimuth), and only a few degrees of arc in the vertical direction (corresponding to elevation). Thus, a cathode ray tube represents an excellent simulation device insofar as it can be programmed with quality simulation images and is of a size commensurate with the field of view.

Nevertheless, cathode ray tube displays have inherent limitations in terms of reality and size. Thus, if one wishes a simulation with a high degree of reality, such simulators are inappropriate. Similarly, if activity is contemplated over a wide range of azimuthal and elevational values, such systems will not function properly.

Still another disadvantage of such systems is the extremely high cost of generating the software needed to operate the simulator. For example, in the case of using a three-dimensional data base from which visual information is generated during simulation, the generation of the data base is an extremely time-consuming operation involving definition of a topography, digitizing the same, using computer and related techniques to enhance the resolution of the digitization, and, of course, the time and expense constraints of outputting a simulation from the data base.

SUMMARY OF THE INVENTION

The invention, as claimed, is intended to provide a remedy. It solves the problem of providing a low-cost means for simulating a training exercise. The cost of the training unit is extremely low. At the same time, a high degree of realism is provided. Generation of data bases for training exercises can be done very inexpensively and with a minimum of time with an extremely high degree of realism. At the same time, both the programming and play out apparatus is extremely lightweight, rendering it suitable for portable operation. The degree of skill needed to generate training exercises is also relatively low and the same may be done on site and customized to the local terrain. Thus, soldiers may be trained under actual battlefield conditions in an environment which simulates the actual area where they will be called upon to perform.

The above is achieved through the employment of a small cathode ray tube which produces images that are presented against the outside world due to use of relatively large holographic notch reflector tuned to reflect the output of the cathode ray tube toward the trainee. The cathode ray tube may be contained in a sight attached to a launcher and a portion of the output of the cathode ray tube may be diverted to the scope or other sighting device in order that a target generated at the cathode ray tube may be viewed through the sight as well as against the real world outside the sight.

Means is provided for displaying the position of the simulated target on the cathode ray tube in such a manner that it remains on a stationary path with respect to the outside world by detecting the azimuth and elevation of the gun. Target path simulations are generated by the instructor's sighting the path of the desired target through the sight of the gun, and recording a desired path of movement. Speed of movement may be programmed in at the same time, or may be generated by a computer which stores the path.

Occultation of the target "behind" mountains or other terrain features may be achieved by manual entry during sighting of the path, or may be entered at a control console provided with a view of the real world on cathode ray tube together with the path by an imaging device located within the training sight or scope.

Alternatively, a target may be "driven" by an instructor viewing the real world and the reticle via a remote cathode ray tube.

Through the use of a relatively narrow notch holographic reflector, the target simulation may be projected against a relatively large solid angle of the real world while permitting a surround about the target for acquisition purposes. The use of a holographic notch filter results in minimal colorization of the outside world while at the same time providing high degree of reflectivity to the particular wavelength emitted by the target generating cathode ray tube. Additionally the notch filter provides transmission of the outside world view in excess of 90%. The use of a holographic optical element is also particularly advantageous in view of the relatively large size to which such elements may be made at relatively low cost. The holographic element may be shaped to have a reflective focusing power, or reflective focusing power may be built into a flat element through standard holographic techniques.

BRIEF DESCRIPTION OF THE DRAWINGS

One way of carrying out the invention is described in detail below with reference to drawings which illustrate only one specific embodiment of the invention and in which.

BEST MODE FOR CARRYING OUT THE INVENTION

Figure 1:
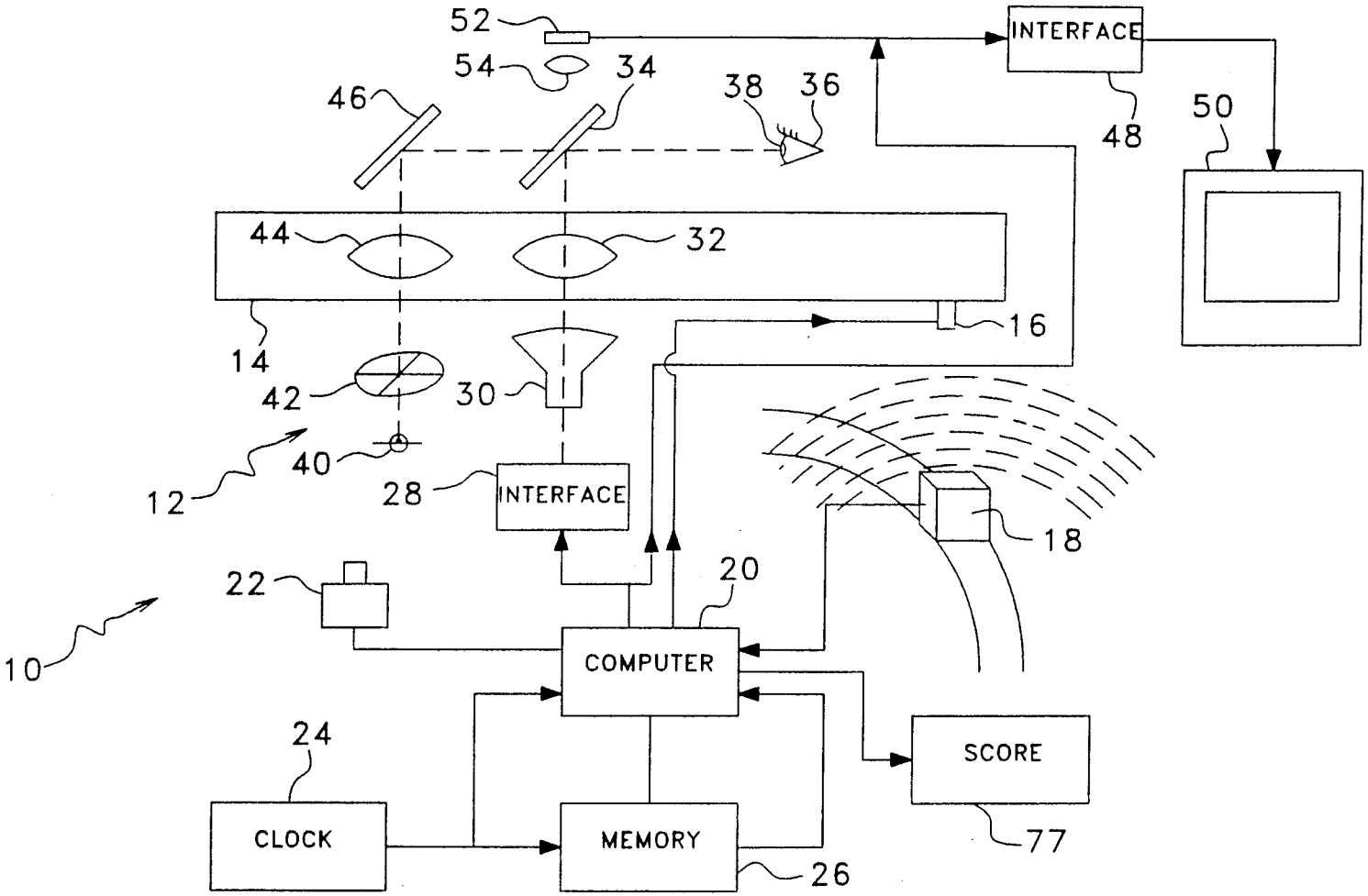
FIG. 1 is a block diagram of the inventive system.

Referring to FIG. 1, a simulator 10 constructed in accordance with the present invention is illustrated.

Simulator 10 comprises an optical unit 12 mechanically coupled to a launcher barrel 14 and functions as a sight for the barrel. The barrel may be of a theoretical weapon or a simulation of an actual weapon system, such as the STINGER launcher.

At the end of the launcher barrel 14, a magnetic receiver 16 is positioned. Magnetic receiver 16 is part of a system such as the Polhemus or other systems manufactured by Ascension which, together with a radiator 18 functions to generate azimuth and elevation information which is input into a computer 20. The azimuth and elevation information input into computer 20 may be used either to record a lightpath or to replay a target event, depending upon whether the system is being programmed or being used to provide the trainee with a problem to be solved.

Computer 20 is coupled to a switch 22 which provides on/off information to computer 20, as more fully appears below. Likewise, a clock 24 is coupled to computer 20 and to a memory circuit 26 which is adapted to receive information from computer 20 and to provide computer 2 with said information for the purpose of simulating an event with which it has been provided during programming.

Computer 20 has an output coupled to a graphic interface board of 28 of conventional design. Graphic board 28 is, in turn, coupled to a cathode ray tube 30 which has its optical output coupled via a lens 32 and a half silvered mirror 34 to the eye 36 of the trainee which is positioned within a pupil 38, within which the eye may see the output of optical unit 12.

Likewise, a light source 40 illuminates a reticle 42 which is imaged by a lens 44 and a half-silvered mirror 46 toward eye 36.

In similar fashion, the output of computer 20 is also provided to a video interface 48 which in turn drives a monitor 50 located at the position of an instructor. Interface 48 is also provided with the output of a charge coupled imaging device 52 which is provided with an image of the outside world by half-silvered mirror 34 and focusing lens 54 and is provided with the image displayed by cathode ray tube 30 by light passing from cathode ray tube 30 to half-silvered mirror 34.

Figure 2:
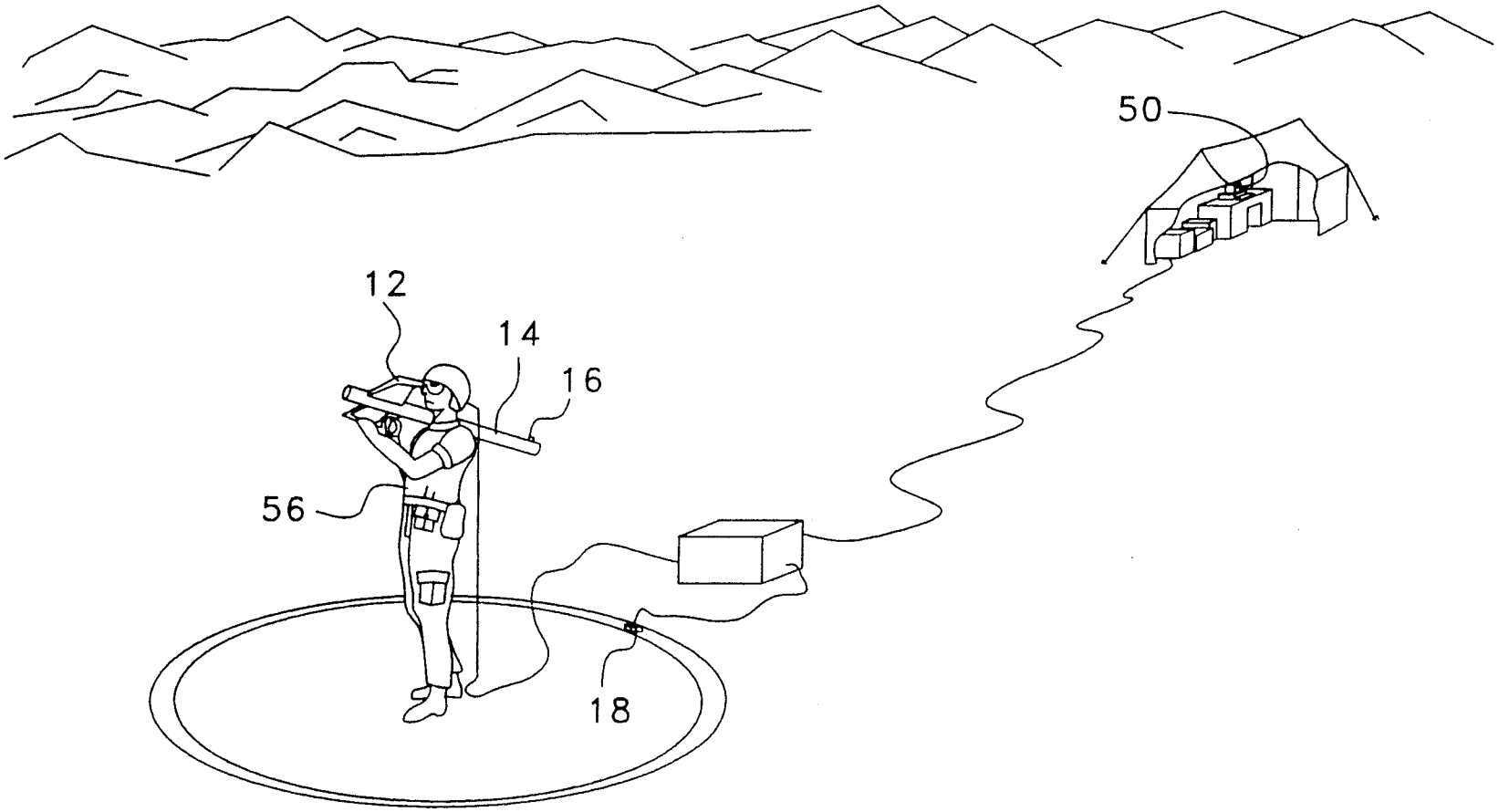
FIG. 2 is a perspective view of the inventive system.

The systems schematically illustrated in FIG. 1 may take the physical form illustrated in FIG. 2. Here, a trainee 56 holds the barrel 14 and sights through the optical unit 12. Depending upon the position of barrel 14, the position and orientation of magnetic receiver 16 will result in the detection of a signal from the radiator which will indicate the azimuth and elevation of the barrel. This information, together with video information generated by charge coupled imaging device 52 will be sent to the monitor 50 of an instructor at a remote position.

Figure 3:
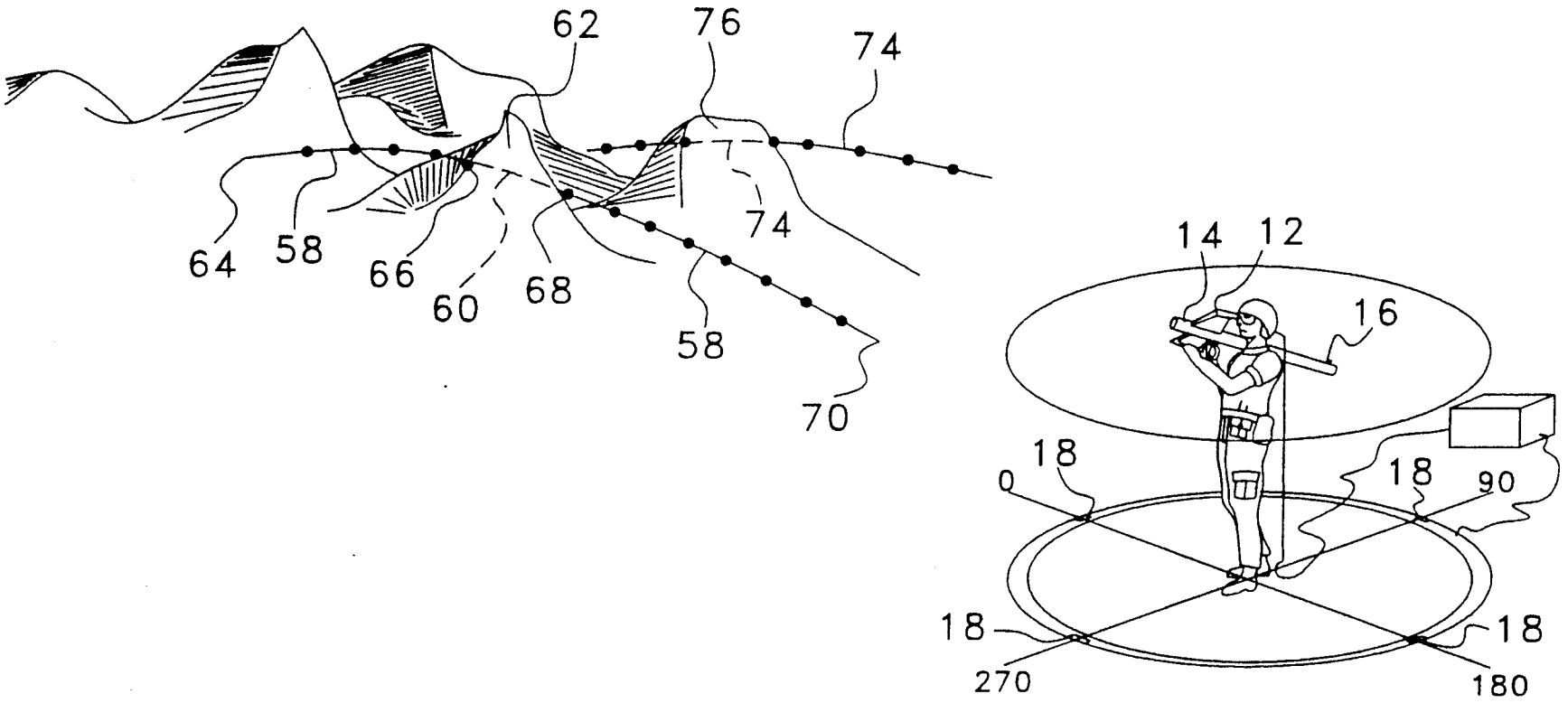
FIG. 3 illustrates programming of the inventive system.

Referring to FIG. 3, the programming of the simulator 10 of the present invention is illustrated. If we design a path 58 which includes a portion 60, where it is behind a terrain feature such as mountain 62, this path can be defined by sighting it through the optical unit 12. At the same time, the azimuth and elevation of the barrel 14 may be recorded by computer 20. The programming operation may be initiated by the depression of button 22 at point 64 and the release of the button at point 66 while sighting along path 58 is being done. Likewise, button 22 would again be depressed at point 68 and would not be released until sighting has reached point 70.

Azimuth and elevation for all points on the curve would be derived by computer 20 and recorded in memory 26 for later play back using software very similar to that used in, for example, drafting programs or the like. The release of button 22 while the barrel is being sighted along path portion 60 results in the blanking of the target during a portion of the path 58 corresponding to positions behind mountain 62.

In similar fashion, a second path 72 including a portion 74 corresponding to path positions behind a mountain 76 may be traced out and stored in memory 26.

It is noted that the time for the movement of the target along the path cited during the above operations is independent of the time that the instructor uses to position the target path during programming. Rather, the various positions along the paths are stored and played back with a display of the target along the path moving with a speed selected by the computer depending upon the nature of the target and its distance from the trainee. This can be obtained with a range finder of conventional design.

During playback, target positions are sent from memory 26 to computer 20 which outputs an image signal to interface 28 which in turn causes the same to be displayed on the screen of cathode ray tube 30. This image is, in turn, focused by lens 32 onto half-silvered mirror 34 for viewing by the eye 36 of the trainee. Simultaneously, trainee 36 views a image of reticle 42 focused by lens 44 toward the eye along the path folded by half-silvered mirror 46. Because both mirrors 34 and 46 are half-silvered, the trainee can see the outside world through them. Similarly, charged coupled imaging device 52 has an image of the outside world projected on it by focussing lens 54 so that this information is sent via interface 48 to the instructor's monitor 50.

During playback, switch 22 or a separate switch acts as a firing switch and the computer compares the azimuth and elevation of the target at the firing time to the azimuth and elevation of the target at that time to generate a score for the trainee's performance. This may be displayed on a separate monitor 77.

During display of target information, several objects may be displayed on cathode ray tube 30 simultaneously at speeds which may vary with respect to each other. An alternative optical unit is illustrated in FIGS. 4 and 5.

Figure 4:
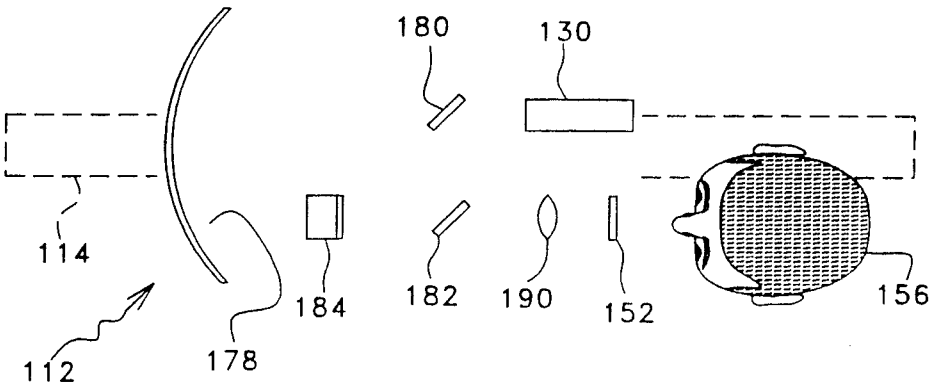
FIGS. 4 and 5 illustrate an alternative embodiment in top plan and side view schematic form.
Figure 5:
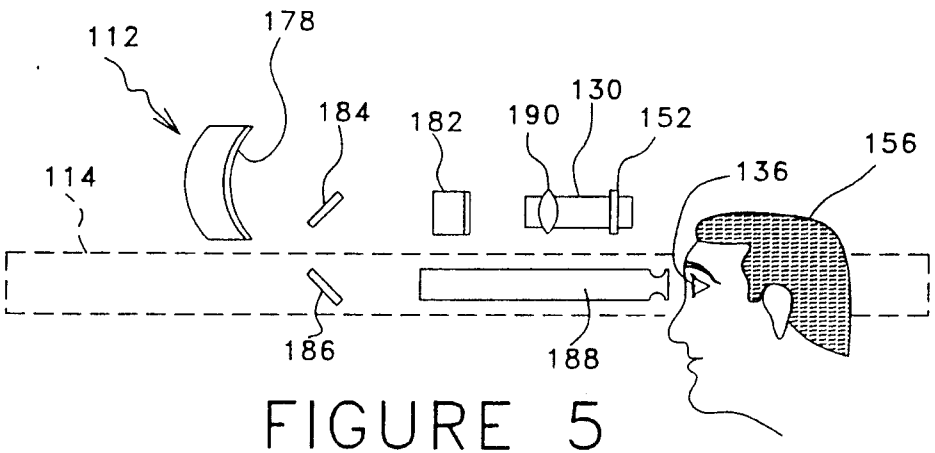

An alternative embodiment is illustrated in FIGS. 4–5. Generally, similar parts or parts performing analogous, corresponding or identical functions to those of the FIGS. 1-3 embodiment are numbered herein with numbers which differ from those of the earlier embodiment by multiples of one hundred.

In accordance with this arrangement, a launcher barrel 114 is provided with a optical unit 112 which includes a wide angle notch reflector 178 which has the characteristic of reflecting light of a particular wavelength. Such a notch reflector may be made in accordance with known holographic techniques and has the advantage of minimal colorization of the outside world, while providing for a high degree of reflectivity with respect to light at the wavelength output by the display cathode ray tube 130. More particularly, light output from cathode ray tube 130 is caused to reflect against notch reflector 178, causing it to show the image against the outside world. At the same time, the output of cathode ray tube 130 is reflected by a notch reflecting mirror 180. Light, in turn, is reflected to a second notch reflective mirror 182 which in turn reflects the image from cathode ray tube 130 to a third notch reflective mirror 184 which, in turn, reflects the light to a fourth notch reflective mirror 186 which directs it through a telescope sight 188 to the eye 136 of trainee 156.

At the same time, a view of the outside world is focused by lens 190 against a charge coupled imaging device 152. The arrangement illustrated in FIGS. 4 and 5 has the particular advantage that the trainee can see the target against the outside world without looking through telescope sight 188 for target acquisition purposes.

While an illustrative embodiment of the invention has been described above, it is, of course, understood that various modifications will be apparent to those of ordinary skill in the art. Such modifications are within the spirit and scope of the invention, which is limited and defined only by the appended claims.

I claim:

1. A simulator for recording a simulated target path and later displaying a target moving along said path during a playback sequence comprising:

(a) a simulated weapon;

(b) a sight secured to said simulated weapon;

(c) means for detecting the azimuth and elevation at which said simulated weapon is oriented;

(d) storage means, coupled to said means for detecting the azimuth and elevation of the simulated weapon, for storing said azimuth and elevation for a plurality of points at which said simulated weapon is aimed, as said simulated weapon is moved to define a path of a target to be simulated during a programming operation, and for outputting at an output port said azimuth and elevation information defining said path;

(e) image generating means coupled to said output port of said storage means to receive azimuth and elevation information output from said storage means and to convert said information during the playback sequence into an optical image on an optical display device, the position of said optical image being a function of said azimuth and elevation information;

(f) optical coupling means for receiving said image and introducing said image into said sight during said playback sequence.

2. A simulator as in claim 1, wherein said means for detecting comprises a computer programmed with graphic software and a position detecting transducer coupled to said computer.

3. A system as in claim 2, wherein said optical coupling means comprises a partially reflective mirror positioned to allow a view of the outside world through said sight and positioned to couple said image from said image generating means into said sight.

4. A simulator as in claim 3, wherein said partially reflective mirror is a holographic notch filter or a half-silvered mirror.

5. A simulator as in claim 4, wherein said image generating means couples said optical image to a partially reflective member positioned outside of said slight whereby the image from said image generating means is seen reflected by said partially reflective member and against the outside world without the operator's looking through said sight.

6. A simulator as in claim 5, wherein said optical coupling means further comprises an imaging device adapted to receive the view through said sight and generate a video picture of the same for viewing at a remote location.

7. A simulator as in claim 6, wherein said storage means is responsive to a switch whose state determines whether an object is to be blanked in correspondence with a simulated passage behind a terrain feature during generation of a path during programming of said system.

8. A simulator as in claim 7, wherein said system comprises means for generating a firing sequence, and comparing the azimuth and elevation of the simulated weapon at a time of firing with the azimuth and elevation of a target to generate a scoring of performance.

9. A simulator as in claim 1, wherein said image is the image of a simulated target.

10. A simulator as in claim 5, wherein said partially reflective mirror is a holographic notch filter.

11. A simulator as in claim 3, wherein said storage means is responsive to a switch whose state determines whether an object is to be blanked in correspondence with simulated passage behing a terrain feature during generation of a path during programming of said system.

* * * * *